US010525492B2

(12) United States Patent
Ezzina et al.

(10) Patent No.: US 10,525,492 B2
(45) Date of Patent: Jan. 7, 2020

(54) MOLDED PUMP FOR DISPENSING A FLUID PRODUCT

(71) Applicant: ALBEA SERVICES, Gennevilliers (FR)

(72) Inventors: Emir Ezzina, Montigny (FR); Eric Rossignol, Chalon sur Saone (FR)

(73) Assignee: ALBEA SERVICES, Gennevilliers (FR)

( * ) Notice: Subject to any disclaimer, the term of this patent is extended or adjusted under 35 U.S.C. 154(b) by 0 days.

(21) Appl. No.: 16/016,530

(22) Filed: Jun. 22, 2018

(65) Prior Publication Data

US 2018/0369843 A1 Dec. 27, 2018

(30) Foreign Application Priority Data

Jun. 22, 2017 (FR) ..... 17 55731

(51) Int. Cl.
*B05B 11/00* (2006.01)

(52) U.S. Cl.
CPC .... *B05B 11/3033* (2013.01); *B05B 11/00414* (2018.08); *B05B 11/3032* (2013.01); *B05B 11/3035* (2013.01); *B05B 11/3052* (2013.01); *B05B 11/3069* (2013.01); *B05B 11/3097* (2013.01); *B05B 11/3059* (2013.01)

(58) Field of Classification Search
CPC ..... B05B 11/00414; B05B 11/3032; B05B 11/3033; B05B 11/3035; B05B 11/3052
USPC ..... 222/207, 209, 213, 383.1
See application file for complete search history.

(56) References Cited

U.S. PATENT DOCUMENTS 3,486,663 A 12/1969 Humphrey
3,726,442 A * 4/1973 Davidson ..... B05B 11/303 222/207
3,753,518 A 8/1973 Kutik
3,820,689 A * 6/1974 Cocita ..... B05B 11/3032 222/207
5,271,432 A 12/1993 Gueret
5,413,250 A * 5/1995 Gueret ..... A45D 34/04 222/105
5,505,341 A * 4/1996 Gueret ..... B05B 11/3032 222/207
7,357,335 B2 * 4/2008 Laidler ..... B05B 11/0027 239/302
7,775,461 B2 * 8/2010 Laidler ..... B05B 11/0027 239/323
2006/0186139 A1 * 8/2006 Laidler ..... B05B 11/0027 222/207

(Continued)

*Primary Examiner* — Vishal Pancholi
(74) *Attorney, Agent, or Firm* — Steven M. Greenberg, Esq.; Shutts & Bowen LLP

(57) ABSTRACT

A pump for dispensing a fluid product, able to be mounted on a container of the flexible tube or rigid flask type, includes a variable-volume metering chamber at least partly defined by a membrane deformable between an initial state in which the volume of the metering chamber is maximum and a deformed state in which the volume of the metering chamber is minimum. The pump also includes a valve for admitting the fluid product to the metering chamber. The pump further includes a valve for discharging the fluid product from the metering chamber. Finally, the pump includes means for opening and closing the admission and discharge valves. Notably, the pump consists of a single molded piece.

13 Claims, 4 Drawing Sheets

(56) References Cited

U.S. PATENT DOCUMENTS

| | | | | |
|---|---|---|---|---|
| 2006/0243825 | A1 | 11/2006 | Laidler et al. | |
| 2007/0164052 | A1* | 7/2007 | Julian Pidevall ... | B05B 11/3032 222/207 |
| 2009/0302064 | A1* | 12/2009 | Lavabre ..... | B05B 11/0027 222/207 |

* cited by examiner

MOLDED PUMP FOR DISPENSING A FLUID PRODUCT

CROSS-REFERENCE TO RELATED APPLICATIONS

This application claims priority under 35 U.S.C. ¬ß119(a) to French Patent Application No. 1755731, filed Jun. 22, 2017.

BACKGROUND OF THE INVENTION

Field of the Invention

The invention relates to a pump for dispensing a fluid product as well as a method for manufacturing such a pump.

Description of the Related Art

Some flasks of cosmetic products are provided with a pump configured so as to aspirate the cosmetic product contained in the reservoir of the flask in order to dispense it, for example by means of a nozzle or through a simple opening. The product can thus be extracted or atomized from the flask to allow application thereof. The pump is often actuated by means of a push button on which the user exerts a pressure in order to trigger the functioning of the pump. A pump includes in particular a metering chamber, the volume of which varies to allow aspiration of the product in the chamber through an inlet orifice, when the volume increases, and then expulsion thereof out of the chamber through an outlet orifice, when the volume of the chamber decreases. The product leaves the chamber in a dispensing pipe, which leads to the opening or nozzle normally arranged on the push button.

Various kinds of pump are known, each having particular features, in order to function specifically, either with low-viscosity liquid products, or with viscous liquid products, such as creams or foams. Thus there exist pumps, the chamber of which is formed by a rigid body and a piston that closes the chamber, and where the movement of the body reduces or increases the volume of the chamber. The movement of the piston is in general controlled by actuating the push button. Such a pump is often used for liquid products to be vaporized.

Other pumps exist for a more viscous product, the chamber of which is defined to a major extent by a flexible membrane. The volume of the chamber is controlled by deformation of the membrane. In a non-deformed configuration of the membrane, the volume of the chamber is maximum. When the membrane is deformed, the volume of the chamber decreases, preferably to a fairly small volume so that a maximum amount of product leaves the chamber. Such pumps further have the advantage of avoiding having recourse to a metal spring, the elements of the pump being made from plastics material.

These flexible-membrane pumps are generally composed of an assembly of a plurality of pieces, some of which may be molded. Pumps therefore exist in two or three pieces requiring assembly of the components post-molding by an additional machine and/or in the mold.

BRIEF SUMMARY OF THE INVENTION

Embodiments of the present invention address deficiencies of the art in respect to fluid dispensing pumps and provide a novel and non-obvious metering dispensing device of the pump type that is simple with a minimum number of components in order to reduce the production costs as well as manufacturing time. The objective is to produce a pump ready to use directly on leaving the molding step, and which can be assembled subsequently either on a flexible tube with the head at the bottom, or on a rigid container of a flask. The invention thus relates to a pump for dispensing a fluid product able to be mounted on a container of the flexible tube or rigid flask type, that includes the following:

- a variable-volume metering chamber at least partly defined by a membrane deformable between an initial state in which the volume of the metering chamber is maximum and a deformed state in which the volume of the metering chamber is minimum;
- a valve for admitting the fluid product to the metering chamber;
- a valve for discharging the fluid product from the metering chamber;
- means for opening and closing the admission and discharge valves.

This pump is characterized mainly in that it consists of a single molded piece. In one embodiment, the invention relates to the fabrication of a pump in a single injection-molded component. There are therefore no post-molding assembly operations. A single mold makes it possible to obtain this pump and thus limits the investment cost. This pump is intended to dispense a cream or a more or less liquid fluid. It does not include any metal parts such as a spring or ball. This pump has a form that can be integrated on various supports of the tube, bottle, flask, etc. type. According to the various embodiments of the invention, which can be taken together or separately:

- the piece consists of a first flexible material and a second rigid material: this is therefore a case of bi-injection molding. The flexible material makes it possible to offer resilience to the metering chamber. The rigid material forms the carrier structure of the piece;
- the piece consists of two parts, namely a body and a cap, connected by an articulation of the film hinge type: the mold therefore provides a location for the body, a location for the cap, and an intermediate zone for the film hinge connecting the body and the cap. At the time of molding, the pump is open. When the elements are still in the mold, the cap is folded over the body by folding the film hinge. The pump thus closed can be ejected out of the mold. It is ready for use;

The cap includes:

- the deformable membrane having a central axis X;
- a control rod extending orthogonally along the axis X from the membrane in the direction of the body when the cap is positioned on the body;
- means for closing and opening the admission valve;
- a discharge orifice of the discharge valve;

The body includes:

- a rigid structure able to be fixed to a container;
- an admission orifice of the admission valve;
- the means for opening and closing the discharge valve;
- a support in which a hole intended to accept the control rod of the pump is formed;

The means for opening and closing the admission valve consist of a flexible tongue resiliently closing the admission orifice. The flexible tongue separates from the admission orifice under the effect of the negative pressure in the metering chamber when the membrane returns between the deformed state and the initial state. The control rod is able to move in translation along the axis X between a raised position in which the membrane is in its initial state and a pressed-in position in which the membrane is in its deformed state, the activation of the control rod takes place following a pressure exerted on the membrane in order to make it pass from its initial state to its deformed state, The means for closing and opening the discharge valve consist of a flexible frustoconical zone resiliently closing the discharge orifice and extending around the support.

The control rod is mounted clamped in the hole of the support and the translation movement of the rod between the raised position and the pressed-in position causes a deformation of the frustoconical zone so as to open the discharge orifice from the start of the deformation of the membrane, and the return of the rod to its raised position causes the replacement of the frustoconical zone so as to close the discharge orifice. The support includes a chimney delimiting the hole accepting the control rod, the rod including a free end provided with a stop able to come into contact with the chimney.

In the initial state of the membrane, the stop of the rod exerts a force on the chimney of the support in order to hold in place the frustoconical zone so as to close the discharge orifice. The return between the deformed state and the initial state of the membrane takes place by resilient reaction of the membrane.

The pump includes means for geometric protection against the uncontrolled action of the pump: it may for example be a rigid rim that protects against accidental actuation of the pump.

The invention also relates to a method for manufacturing a pump as described above, and including the following steps:

- molding a single piece including two main parts, namely a body and a cap, connected by a film hinge;
- folding the film hinge, in the mold, so as to position the cap on the body and to close the pump,
- removing the closed pump ready for use from the mold.

This method thus makes it possible to close the piece before it is completely ejected out of the mold. Once the piece is ejected, there is no longer any assembly step. The pump is ready for use.

Additional aspects of the invention will be set forth in part in the description which follows, and in part will be obvious from the description, or may be learned by practice of the invention. The aspects of the invention will be realized and attained by means of the elements and combinations particularly pointed out in the appended claims. It is to be understood that both the foregoing general description and the following detailed description are exemplary and explanatory only and are not restrictive of the invention, as claimed.

BRIEF DESCRIPTION OF THE SEVERAL VIEWS OF THE DRAWINGS

The accompanying drawings, which are incorporated in and constitute part of this specification, illustrate embodiments of the invention and together with the description, serve to explain the principles of the invention. The embodiments illustrated herein are presently preferred, it being understood, however, that the invention is not limited to the precise arrangements and instrumentalities shown, wherein.

DETAILED DESCRIPTION OF THE INVENTION

Figure 4:
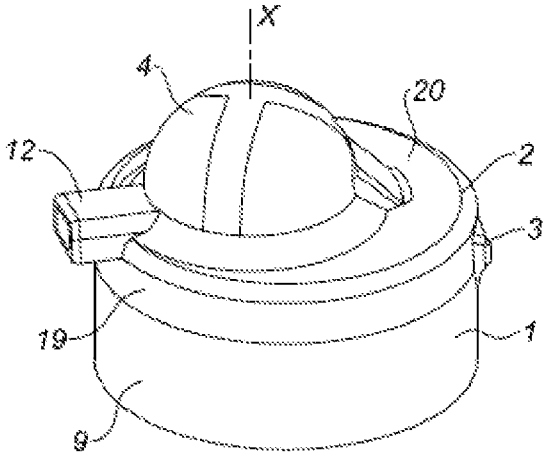
FIG. 4 is a perspective view of the closed pump, still according to the first configuration.
Figure 11:
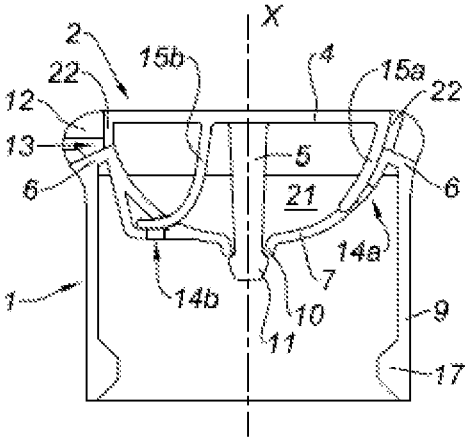
FIG. 11 illustrates the closed pump according to the second configuration.

In the description, the terms relating to positioning in space are taken with reference to the upright position of the pump as shown in particular in FIG. 4 and FIG. 11. It should be noted that, in the figures, the structural and/or functional elements common to the various embodiments may have the same references. Thus, unless mentioned to the contrary, such elements have identical structural, dimensional and physical properties.

Figure 1:
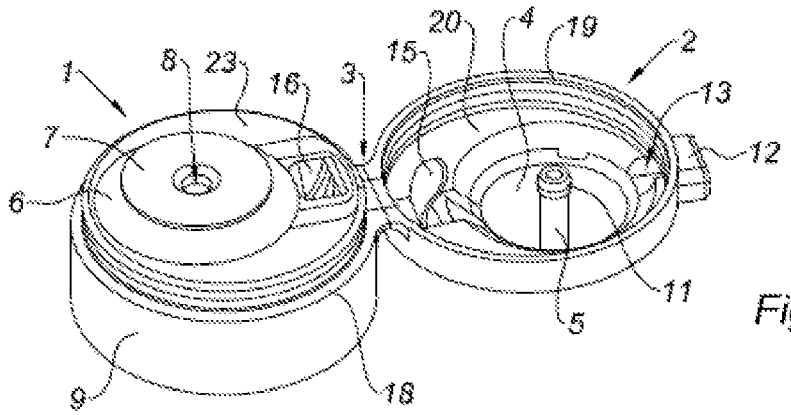
FIG. 1 is a perspective view of a first possible configuration of an open pump according to the invention.
Figure 2:
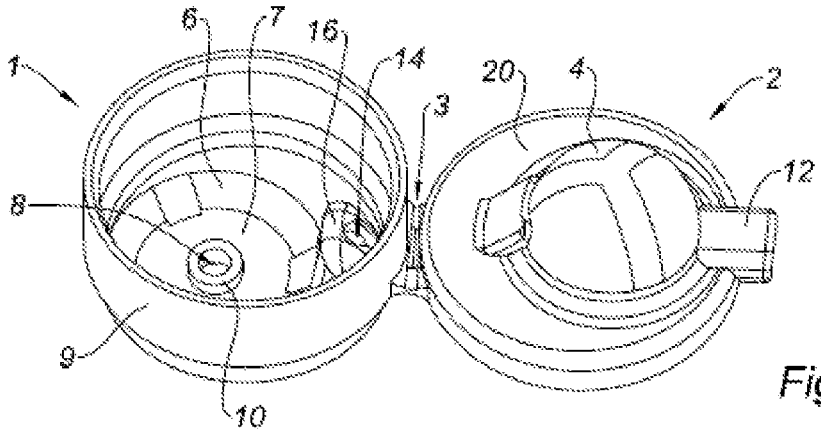
FIG. 2 is a perspective view of the pump according to FIG. 1, turned over on a horizontal plane.
Figure 3:
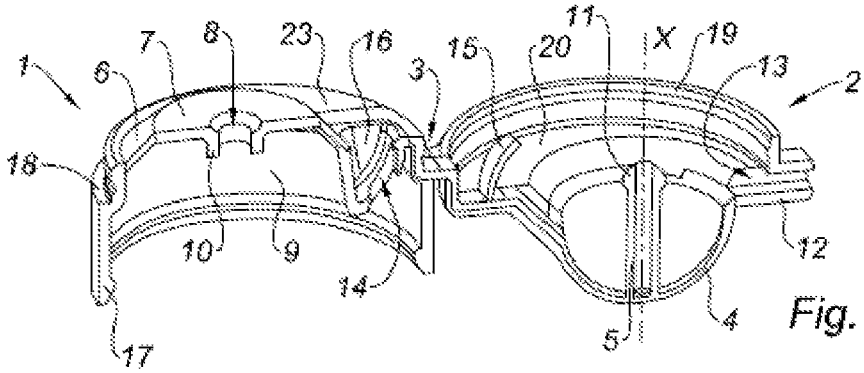
FIG. 3 is a view in perspective and cross section of the pump according to FIG. 1.

The invention relates to a pump molded in a single piece, as can be seen in FIG. 1 for example. This piece is broken down into a first part, namely a body 1, and a second part, namely a cap 2, the body 1 and the cap 2 being connected by a film hinge 3. All these elements are obtained in a single mold.

During molding, the pump is open, which means that the cap 2 is deployed with respect to the body 1. At the end of molding, the cap 2 is folded over the body 1 by folding the film hinge 3 so as to close the pump. The pump thus closed can be removed from the mold.

The cap 2 constitutes the top part of the pump, and the body 1 constitutes the bottom part of the pump.

The cap 2 comprises a push button on which the user can press in order to actuate the pump. A dose of product then leaves via an end piece 12, when the pump is mounted on a container filled with product to be dispensed.

Figure 12:
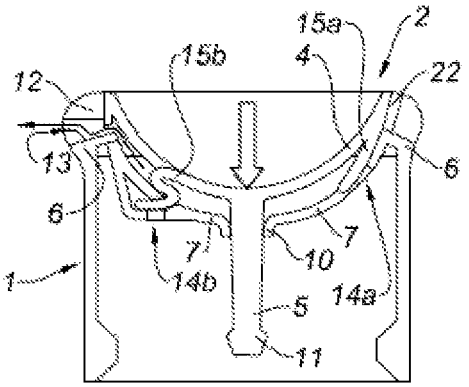
FIG. 12 shows the actuation of the pump according to the second configuration.
Figure 13:
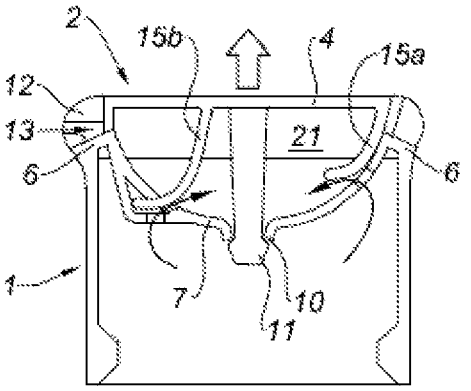
FIG. 13 shows the release of the pump according to the second configuration; and, FIG. 14 shows the return of the pump to its closed position and is identical to FIG. 11.
Figure 14:
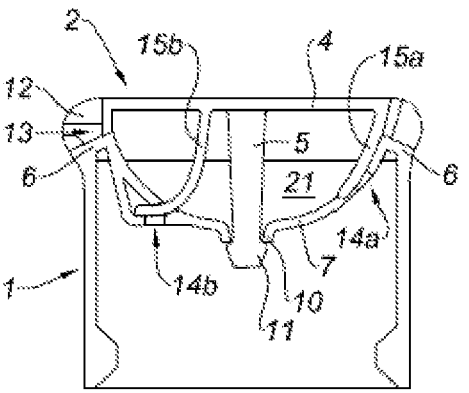

In concrete terms, the push button consists of a deformable membrane 4 on which the user can press. This membrane 4 partly defines a metering chamber 21 containing a dose of product to be delivered. The pump functions by varying the volume of this metering chamber 21 by resilient deformation of the membrane between an initial state shown in FIGS. 4, 5, 9, 11, 14 in which the chamber 21 has a maximum volume and a deformed state shown in FIGS. 7, 8, 12 in which the volume of the chamber 21 is at a minimum, causing the expulsion of the dose of product through the end piece 12.

The membrane 4 comprises a central axis of symmetry X. A control rod 5 extends orthogonally from the membrane 4, along the axis X, and in the direction of the body 1 when the cap 2 is positioned on the body 1. In other words, the control rod 5 extends from the internal surface of the membrane 4, while the external surface of the membrane 4 serves as a bearing surface for the user. The function of this control rod 5 will be explained later in the description.

The body 1 consists of a part of revolution, having a peripheral wall 9, serving as a rigid structure.

The bottom part of the peripheral wall 9 is intended to be placed on a container. To facilitate this placing, a circumferential bulge 17 is formed on the internal surface of the peripheral wall 9. This bulge 17 allows for example resilient fitting of the pump on the container.

The peripheral wall 9 of the body 1 defines a top opening at least partly closed by a support 7. The support 7 and the membrane 4 define together the metering chamber 21.

This support 7 is carried by a deformable frustoconical zone 6. This frustoconical zone 6 surrounds the support 7. A hole 8 is formed at the center of the support 7 for passage of the control rod 5. Optionally, a chimney 10 directed towards the inside of the body 1 increases the depth of the hole 8 and thus makes it possible to better guide the control rod 5 in rectilinear translation. The free end of the control rod 5 is provided with a stop 11 able to come into contact with the free end of the chimney 10 so as to limit the translation movement of the control rod 5. The latter is mounted lightly clamped in the chimney 10.

In the first embodiment illustrated in FIGS. 1 to 9, the support 7 consists of a flat circular plate, projecting from a disc 23 by means of the frustoconical zone 6. The disc 23 entirely closes the top opening delimited by the peripheral wall 9 of the body 1. As for the membrane 4, this consists of a dome in the initial state, the top of which is directed towards the outside of the pump. When the user presses on the dome, the latter deforms so as to form a bowl, the bottom of which comes into contact with the support 7. In this embodiment, the cap 2 comprises a flat top surface 20 from which the dome projects. This dome is off-center with respect to the central axis of the top surface 20.

In the second embodiment illustrated in FIGS. 10 to 14, the support 7 consists of a bowl directed towards the inside of the body 1. The bowl by itself entirely closes the top opening delimited by the peripheral wall 9 of the body 1. As for the membrane 4, this consists of a flat disc in the initial state. When the user presses on the disc, the latter deforms so as to form a bowl that approaches the support 7. In this embodiment, the membrane 4 forms the entire top surface of the cap 2.

Moreover, the pump has an admission valve through which a dose of product to be dispensed can enter in order to go into the metering chamber 21. This admission bowl is composed of:

an admission orifice 14 formed in the body 1 and means for closing and opening this admission orifice 14, consisting of a flexible tongue 15 extending from the cap 2 and resiliently closing the orifice 14.

In the first embodiment, the disc 23 of the body 1 has a hollow 16, the admission orifice 14 being formed in one of the walls of this hollow 16. The tongue 15 enters this hollow 16 and comes to be pressed on the wall in which the orifice 14 is situated, so as to cover it.

In the second embodiment, the admission orifice 14 is formed directly in the support 7. To accelerate the admission of a dose of product in the metering chamber 21, there exist two admission orifices 14*a*, 14*b* diametrically opposed. In the same way, there then exist two tongues 15*a*, 15*b* each covering an admission orifice 14*a*, 14*b*. The tongues 15*a*, 15*b* have different lengths so as to adapt to the location of the admission orifices 14*a*, 14*b* on the support 7. There may exist a plurality of forms of tongue and a plurality of lengths of tongue, according to the dimensions and locations of the admission orifices. The examples proposed are not limitative.

The pump also has a discharge valve through which a dose of product to be dispensed emerges. More precisely, the product emerges from the metering chamber 21 and arrives in the end piece 12 via the discharge valve. This discharge valve is composed of:

a discharge orifice 13 formed in the cap 2 and means for closing and opening this discharge orifice 13, consisting of the previously mentioned frustoconical zone 6.

In the two embodiments, the frustoconical zone 6 resiliently closes the discharge orifice 13, in an initial state in which the support 7 is raised. When the support 7 is lowered, as will be explained later in the description, the frustoconical zone 6 is deformed and opens the discharge orifice 13.

In the first embodiment, the top part of the peripheral wall 9 of the body 1 has a shoulder 18 on which a peripheral wall 19 of the cap 2 comes to be positioned. A circumferential groove is formed in the top end of the peripheral wall 9 of the body 1, and accepts a circumferential rim provided for this purpose in the peripheral wall 19 of the cap 2, so as to provide a resilient fitting-together between the body 1 and the cap 2. This fitting together also provides the seal between the body 1 and the cap 2.

In the second embodiment, no shoulder exists. The cap 2 has a rigid annular rim 22 surrounding the flat membrane 4 so as to prevent any accidental actuation of the pump by pressing on a peripheral zone of said flat membrane 4. As the membrane 4 does not project relative to the plane formed by the rigid rim, unlike the first embodiment, the pressing is exerted on the rigid edges 22 when the flask is placed with its head down on a support. The support thus cannot cause accidental actuation of the pump in this position.

This rim 22 thus consists of a geometric protection against the uncontrolled actuation of the pump. It is preferably designed in polypropylene.

It will thus be noted that, according to their role, the various elements constituting the pump are either flexible or rigid. In this case, the membrane 4, the frustoconical zone 6, the film hinge 3 and the tongues 15, 15*a*, 15*b* are formed from a flexible resilient material, of the thermoplastic elastomer (TPE) type. As for the other elements, they consist of a rigid material. The molding of the pump is therefore carried out by bi-injection of a flexible material and a rigid material in the same single mold in order to form the single piece.

Figure 5:
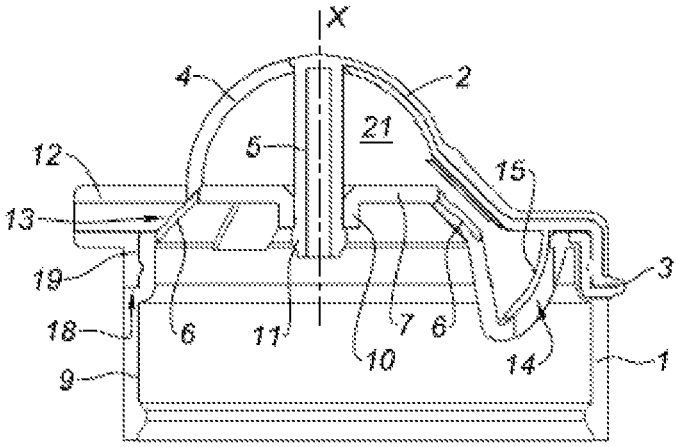
FIGS. 5 to 9 are views in cross section that show the various steps of actuation of the pump according to the first configuration.

The functioning of the pump is described hereafter according to a first embodiment. In FIG. 5, the pump is in the idle position. The pump is fluid-tight, the cap 2 being fitted on the body 1. The membrane 4 is in its initial state, in the form of a dome, and the rod 5 is in the raised position. The resilient reaction of the prestressed dome 4 tends to pull on the control rod 5. The stop 11 of the control rod 5 is in contact with the chimney 10 and tends to raise the support 7 as well as the frustoconical zone 6. This frustoconical zone 6 then obstructs the discharge orifice 13. The admission orifice 14 is closed by the tongue 15. The metering chamber 21 is filled with a dose of product to be dispensed. The pressure inside the chamber 21 is identical to the pressure outside the chamber, and the tongue 15 is pressed on the seat of the admission orifice 14 by simple resilient effect. The closure of the admission valve is thus fluid-tight.

Figure 6:
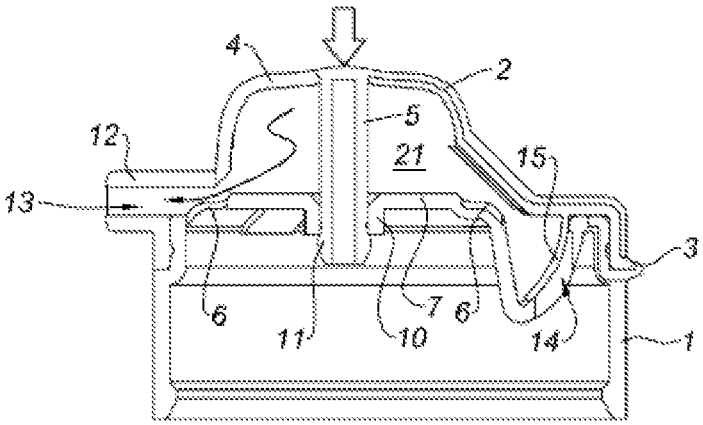
Figure 7:
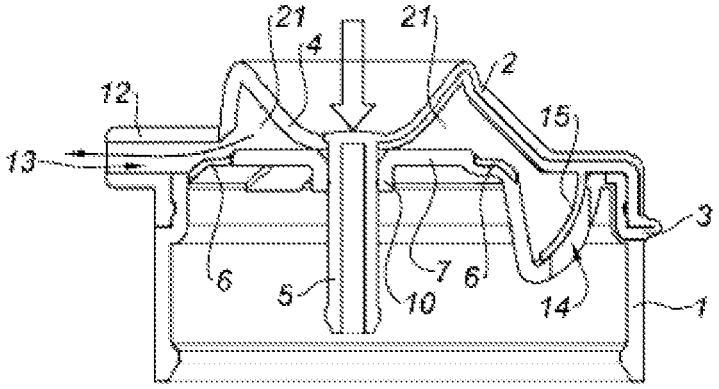

In FIG. 6, a pressure is exerted on the top of the dome 4. The control rod 5 is lightly clamped in the chimney 10 and thus drives the chimney 10 and the support 7 downwards, causing a deformation of the frustoconical zone 6 and opening of the discharge orifice 13 whereas the membrane 4 is only slightly deformed. Consequently the fluid is dispensed without being subjected to high pressures. Moreover, risks of phase separation in the lotion are thus prevented, and moreover the fluid is not dispensed violently and can be dispensed gently into the hand of the user. In FIG. 7 the membrane 4 is in its deformed state, in the form of a bowl. When the control rod 5 descends following pressing on the membrane 4, the clamping force between the rod 5 and the chimney 10 is overcome and the rod 5 thus translates downwards with respect to the chimney 10 as far as a so-called pressed-in position. The volume of the metering chamber 21 decreases and a major part of the dose of product contained in the metering chamber 21 is dispensed via the end piece 12.

Figure 8:
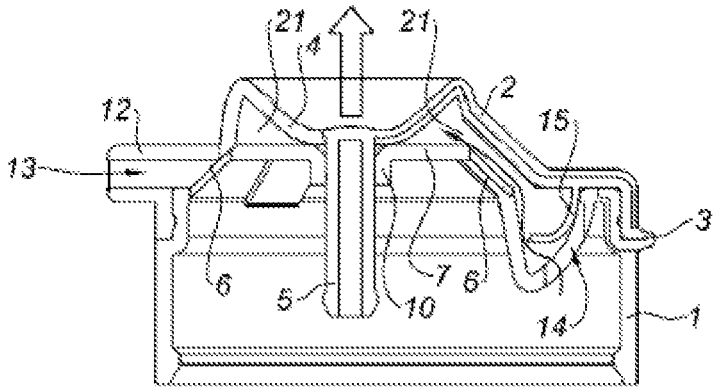

In FIG. 8, there is no longer any pressure on the membrane 4. The resilient reaction of the membrane 4 enables the system to rise again. In particular, the membrane 4 passes from its bowl shape to its dome shape and raises the control rod 5. The chimney 10 being clamped on the rod 5, the raising of the rod 5 tends to make the support 7 rise and to press the frustoconical zone 6 on the discharge orifice 13. The discharge valve is then closed. The volume of the metering chamber increases again. There is a negative pressure in the chamber 21, which causes the opening of the admission valve by raising the tongue 15 so as to open the admission orifice 14 for the fluid product. The aspiration of the product continues until the rod 5 arrives at the top stop under the chimney 10.

Figure 9:
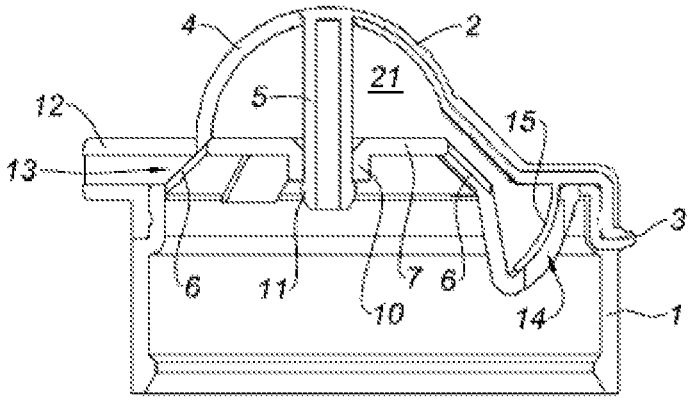
Figure 10:
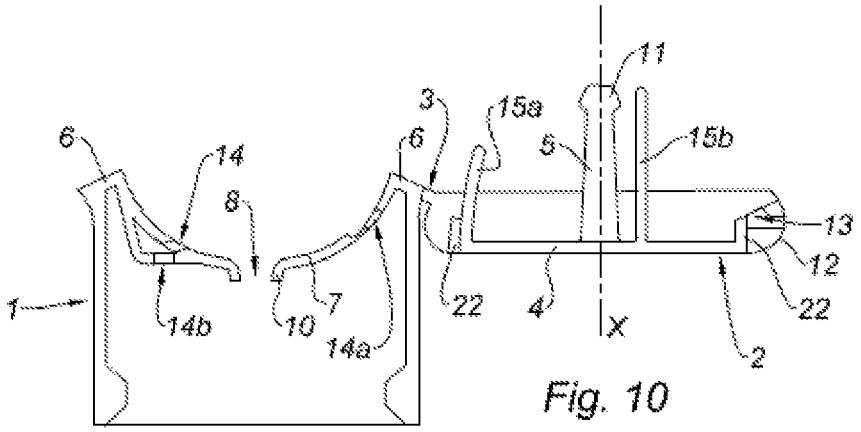
FIG. 10 is a view in cross section of an open pump according to a second possible configuration of the invention.

In FIG. 9, the pump is returned to its idle state. The resilient reaction of the prestressed dome 4 when the system is assembled enables the frustoconical zone 6 to be pressed on the discharge orifice 13. The metering chamber 21 is therefore hermetically closed. The negative pressure having dropped, the tongue 15 of the admission valve, through the intrinsic resilience of the flexible material from which it is designed, is pressed again on the admission orifice 14. The following dose is ready to be delivered.

In a second embodiment, the pump functions in a similar manner to what is described above, except that the membrane 4 is flat in its prestressed initial state, and that it adopts a bowl shape when a pressure is exerted on it.

The configurations shown in the figures cited are merely possible, in no way limitative, examples of the invention, which on the contrary encompasses any variant forms and designs within the capability of a person skilled in the art. Finally, the terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "includes" and/or "including," when used in this specification, specify the presence of stated features and/or components, but do not preclude the presence or addition of one or more other features, components, and/or groups thereof.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

Having thus described the invention of the present application in detail and by reference to embodiments thereof, it will be apparent that modifications and variations are possible without departing from the scope of the invention defined in the appended claims as follows:

What is claimed is:

1. A pump for dispensing a fluid product, and adaptable for mounting on a container of flexible tube or rigid flask type, the pump comprising:

a variable-volume metering chamber at least partly defined by a membrane deformable between an initial state in which the volume of the metering chamber is maximum and a deformed state in which the volume of the metering chamber is minimum;

a valve for admitting the fluid product to the metering chamber;

a valve for discharging the fluid product from the metering chamber;

means for opening and closing the discharge valve;

said pump consisting of a single molded piece consisting of two parts, respectively a body and a cap, connected by an articulation of a film hinge type, wherein, the cap comprises:

said membrane having a central axis;

a control rod extending orthogonally along the axis from the membrane in the direction of the body when the cap is positioned on the body;

means for closing and opening the admission valve; and, a discharge orifice of the discharge valve, wherein the body comprises said means for opening and closing the discharge valve, and wherein the control rod acts on the body to deform the body between a state where the discharge valve of the cap is open, and a state where the discharge valve of the cap is closed.

2. The pump according to claim 1, wherein said single molded piece consists of a first flexible material and a second rigid material.

3. The pump according to claim 2, wherein the body comprises:

a rigid structure able to be fixed to a container;

an admission orifice of the admission valve;

the means for opening and closing the discharge valve; and, a support in which a hole is formed, intended to accept said control rod of the pump.

4. The pump according to claim 3, wherein the means for opening and closing the admission valve consist of a flexible tongue resiliently closing the admission orifice.

5. The pump according to claim 4, wherein the flexible tongue separates from the admission orifice under the effect of the negative pressure in the metering chamber when the membrane returns between the deformed state and the initial state.

6. The pump according to claim 3, wherein the control rod is able to move in translation along the axis between a raised position in which the membrane is in its initial state and a pressed-in position in which the membrane is in its deformed state, the activation of the control rod takes place following a pressure exerted on the membrane in order to make it pass from its initial state to its deformed state.

7. The pump according to claim 3, wherein the means for closing and opening the discharge valve consist of a flexible frustoconical zone resiliently closing the discharge orifice and extending around the support.

8. The pump according to claim 7, wherein the control rod is mounted clamped in the hole of the support and the translation movement of the rod between the raised position and the pressed-in position causes a deformation of the frustoconical zone so as to open the discharge orifice from the start of the deformation of the membrane, and the return of the rod to its raised position causes the replacement of the frustoconical zone so as to close the discharge orifice.

9. The pump according to claim 3, wherein the support comprises a chimney delimiting the hole accepting the control rod, said rod comprising a free end provided with a stop able come into contact with the chimney.

10. The pump according to claim 9, wherein during the initial state of the membrane, the stop of the rod exerts a force on the chamber of the support in order to hold in place the frustoconical zone so as to close the discharge orifice.

11. The pump according to claim 1, wherein the return between the deformed state and the initial state of the membrane takes place by resilient reaction of the membrane.

12. The pump according to claim 11, wherein the body comprises:

a rigid structure able to be fixed to a container;

an admission orifice of the admission valve;

the means for opening and closing the discharge valve; and, a support in which a hole is formed, intended to accept said control rod of the pump;

wherein the means for closing and opening the discharge valve consist of a flexible frustoconical zone resiliently closing the discharge orifice and extending around the support; and, wherein the control rod is mounted clamped in the hole of the support and the translation movement of the rod between the raised position and the pressed-in position causes a deformation of the frustoconical zone so as to open the discharge orifice from the start of the deformation of the membrane, and the return of the rod to its raised position causes the replacement of the frustoconical zone so as to close the discharge orifice;

the pump further comprising means for geometrical protection against its uncontrolled actuation, of the rigid rim type.

13. A method for manufacturing a pump comprising:

molding a single piece comprising a body and a cap connected by a film hinge;

folding the film hinge, in the mold, so as to position the cap on the body and to close the pump, and removing the closed pump ready for use from the mold.

* * * * *